US008522488B1

(12) United States Patent
Newkirk et al.

(10) Patent No.: US 8,522,488 B1
(45) Date of Patent: Sep. 3, 2013

(54) HEADWALL WITH INTEGRAL WALL PANEL INTERFACE

(71) Applicants: David C. Newkirk, Lawrenceburg, IN (US); Dennis J. Gallant, Harrison, OH (US); Joseph H. Abel, New Palestine, IN (US)

(72) Inventors: David C. Newkirk, Lawrenceburg, IN (US); Dennis J. Gallant, Harrison, OH (US); Joseph H. Abel, New Palestine, IN (US)

(73) Assignee: Hill-Rom Services, Inc., Batesville, IN (US)

( * ) Notice: Subject to any disclaimer, the term of this patent is extended or adjusted under 35 U.S.C. 154(b) by 0 days.

(21) Appl. No.: 13/652,205

(22) Filed: Oct. 15, 2012

(51) Int. Cl.
*A47F 10/00* (2006.01)
*E04H 1/00* (2006.01)

(52) U.S. Cl.
USPC ..... 52/36.1; 52/36.4; 52/220.1; 52/387; 52/506.08; 52/779; 312/242; 312/245

(58) Field of Classification Search
USPC ..... 52/27, 36.1, 36.4, 220.1, 384, 387, 52/464, 468, 506.08, 762, 779, 780, 36.5, 52/36.6, 476, 481.2; 312/245, 242
See application file for complete search history.

(56) References Cited

U.S. PATENT DOCUMENTS

| | | | | |
|---|---|---|---|---|
| 2,526,727 | A | | 10/1950 | Bull |
| 2,998,508 | A | | 5/1959 | Bobrick |
| 3,088,178 | A | | 5/1963 | Propst |
| 3,095,625 | A | | 7/1963 | Propst |
| 3,430,997 | A | | 3/1969 | Propst et al. |
| 3,443,350 | A | | 5/1969 | Birum, Jr. |
| 3,462,892 | A | | 8/1969 | Meyer |
| 3,556,455 | A | | 1/1971 | Storm et al. |
| 3,567,842 | A | | 3/1971 | Meyer |
| 3,609,211 | A | | 9/1971 | Van Herk |
| 3,660,591 | A | | 5/1972 | Schultz et al. |
| D226,353 | S | | 2/1973 | Schultz et al. |
| 3,769,502 | A | | 10/1973 | Schultz et al. |
| 4,065,898 | A | | 1/1978 | Munk |
| 4,104,710 | A | | 8/1978 | Damico et al. |
| 4,155,609 | A | | 5/1979 | Skafte et al. |
| D261,804 | S | | 11/1981 | Foster et al. |
| 4,338,485 | A | | 7/1982 | Fullenkamp et al. |
| 4,353,411 | A | | 10/1982 | Harter et al. |
| 4,370,841 | A | * | 2/1983 | Hayashi ..... 52/464 |
| 4,452,499 | A | | 6/1984 | Verburg |
| 4,523,683 | A | | 6/1985 | Fullenkamp et al. |
| 4,559,410 | A | | 12/1985 | Hostetter |
| 4,570,390 | A | * | 2/1986 | Wendt ..... 52/36.6 |
| 4,574,963 | A | | 3/1986 | Fullenkamp et al. |
| 4,589,557 | A | | 5/1986 | Bollmann |
| 4,610,118 | A | | 9/1986 | Fullenkamp |
| 4,632,591 | A | | 12/1986 | Fullenkamp |
| 4,638,606 | A | * | 1/1987 | Wendt ..... 52/36.6 |
| 4,662,524 | A | | 5/1987 | Fullenkamp et al. |
| 4,698,946 | A | * | 10/1987 | Wendt ..... 52/275 |

(Continued)

*Primary Examiner* — Brian Glessner
*Assistant Examiner* — Brian D Mattei
(74) *Attorney, Agent, or Firm* — Barnes & Thornburg LLP

(57) ABSTRACT

A modular architectural system adapted for use with a finished wall in a patient room includes a service unit, a wall-masking panel, and an interface strip. The service unit includes a frame and a plurality of modular panels coupled to the frame to support service outlets relative to the finished wall. The wall-masking panel is spaced apart from the service unit and is arranged along an edge of the service unit. The interface strip is coupled to the service unit and arranged along the edge of the service unit between the service unit and the wall-masking panel to interconnect the service unit and the wall-masking panel.

17 Claims, 9 Drawing Sheets

(56) References Cited

U.S. PATENT DOCUMENTS

| | | | | |
|---|---|---|---|---|
| 4,720,768 | A | 1/1988 | Schindele | |
| 4,725,030 | A | 2/1988 | Miller et al. | |
| 4,738,369 | A | 4/1988 | Desjardins | |
| 4,753,055 | A | 6/1988 | Durham, Jr. | |
| 4,807,659 | A | 2/1989 | Schindele | |
| 4,821,470 | A | 4/1989 | Kappers et al. | |
| D302,502 | S | 8/1989 | Durham, Jr. | |
| 4,869,378 | A | 9/1989 | Miller | |
| D303,743 | S | 10/1989 | Durham, Jr. | |
| D303,889 | S | 10/1989 | Durham, Jr. | |
| 4,905,433 | A | 3/1990 | Miller | |
| 4,993,683 | A | 2/1991 | Kreuzer | |
| 5,247,962 | A | 9/1993 | Walker | |
| 5,277,005 | A | 1/1994 | Hellwig et al. | |
| 5,448,859 | A | 9/1995 | Walker et al. | |
| 5,513,574 | A | 5/1996 | Collins | |
| 5,619,076 | A | 4/1997 | Layden et al. | |
| 5,778,612 | A | 7/1998 | Kissinger et al. | |
| 5,878,536 | A | 3/1999 | Demmitt et al. | |
| 5,911,661 | A | 6/1999 | Murray et al. | |
| 5,961,193 | A | 10/1999 | Hobbs | |
| 6,088,980 | A | 7/2000 | Gulliver | |
| 6,231,526 | B1 | 5/2001 | Taylor et al. | |
| D443,365 | S | 6/2001 | Walker | |
| 6,256,935 | B1 | 7/2001 | Walker | |
| 6,260,321 | B1 * | 7/2001 | Rudduck | 52/474 |
| 6,269,594 | B1 | 8/2001 | Walker | |
| D452,573 | S | 12/2001 | Walker | |
| 6,405,491 | B1 | 6/2002 | Gallant | |
| 7,150,127 | B2 | 12/2006 | Underwood et al. | |
| 7,204,714 | B2 | 4/2007 | Walker et al. | |
| 7,211,726 | B2 | 5/2007 | Bally et al. | |
| 7,950,189 | B1 * | 5/2011 | Walker et al. | 52/27 |
| 2002/0104271 | A1 | 8/2002 | Gallant | |
| 2007/0068089 | A1 * | 3/2007 | Gallant et al. | 52/27 |
| 2010/0095604 | A1 | 4/2010 | Newkirk et al. | |
| 2011/0209835 | A1 * | 9/2011 | Balbona et al. | 160/127 |

* cited by examiner

HEADWALL WITH INTEGRAL WALL PANEL INTERFACE

BACKGROUND

The present disclosure is related to systems and methods for delivering services, energy, and data within a hospital room. More specifically, the present disclosure is related to a modular architectural room system for delivering gases, electrical energy, and data to a hospital room and an associated method of configuring and assembling the modular architectural room system.

Clinical care settings, such as a hospital room, for example, serve a two-fold purpose of delivering healthcare services. In the first instance, the hospital room serves as an area for delivery of medical care. In the second instance, the hospital room serves as a residence for a recuperating patient.

With regard to the delivery of healthcare services, the hospital room must include state of the art technology accessible to the healthcare provider during the delivery of care. As the acuity of a patient's illness or injury increases, the complexity of additional equipment required to assist with the delivery of care increases. The vital signs of a patient are taken on a regular basis. In a critical care/intensive care unit, other monitoring equipment and service delivery equipment is required. For example, vital signs monitoring may be required in conjunction with ventilation equipment. Generally, the support for the equipment is positioned at the head end of the bed in an architectural headwall unit. For example, gases such as oxygen and compressed air may be delivered to the patient room. A vacuum line may also be provided. Electrical service outlets may also be provided with certain devices being connected to power circuits including emergency back-up for critical devices. The architectural headwall units may also provide central lighting controls and may be configured to provide support for healthcare equipment such as monitoring devices and fluid collection canisters.

The delivery of gases and power and the support of healthcare equipment tend to cause the headwall area of a patient room to appear more clinically oriented than residential. In order to provide a more aesthetically pleasing environment for recuperation, hospitals are known to utilize structures within the room constructed employing wood grains and configured with gas and electrical outlets.

SUMMARY

The present application discloses one or more of the features recited in the appended claims and/or the following features which, alone or in any combination, may comprise patentable subject matter:

According to a first aspect of the present application, a modular architectural system for use in a healthcare facility room is disclosed. The illustrative healthcare facility room has a finished wall including studs and facing sheets covering the studs. The modular architectural system may include a service unit and a wall-masking panel. The service unit may include a plurality of modular panels and at least one service outlet coupled to at least one of the modular panels. The wall-masking panel may be adapted to extend over the drywall sheets of the finished wall. The wall-masking panel may have a front surface, a back surface facing away from the front surface, and an interface surface arranged to extend between and interconnect the front surface and the back surface. The interface surface may be formed to include a groove that extends into the wall-masking panel between the front surface and the back surface. The wall-masking panel may be spaced apart from and arranged along an edge of the service unit with the interface surface facing the service unit.

In some embodiments, the modular architectural system may include an interface strip. The interface strip may be coupled to the service unit and arranged along the edge of the service unit between the service unit and the wall-masking panel to interconnect the service unit and the wall-masking panel. The interface strip may be formed to include a tongue that extends into the groove formed in the interface surface of the wall-masking panel and a flange that extends along the front face of the wall-masking panel to cover a portion of the front face.

In some embodiments, the interface strip may include an accessory track forming a C-shape. The C-shape of the accessory track may form an opening facing away from the back surface of the wall-masking panel.

In some embodiments, the service unit may include a frame and a brace coupled to the frame and coupled to the interface strip. The brace may be coupled to the interface strip by a fastener extending through the interface strip and the brace. The brace may be L-shaped.

In some embodiments, the flange may extend directly from the accessory track. The flange may be L-shaped.

In some embodiments, the interface strip may be formed to include a bracket and the tongue may extend directly from the bracket. The accessory track may extend directly from the bracket. The flange may extend directly from the accessory track. The bracket may extend along the entire interface surface of the wall-masking panel. The interface strip may be coupled to the service unit by a fastener that extends through the accessory track and the bracket.

In some embodiments, the service outlet may be a medical gas outlet. The groove formed in the interface surface of the wall-masking panel may be located about mid-way between the front surface and the back surface of the wall-masking panel. In some embodiments, the accessory track may be D-shaped.

According to a second aspect of the present disclosure, a modular architectural system for use in a healthcare facility room is disclosed. The modular architectural system may include a service unit and a wall-masking panel. The service unit may include a plurality of modular panels and at least one service outlet mounted in at least one of the plurality of modular panels. The wall-masking panel may have a front surface, a back surface, and an interface surface. The back surface may be spaced apart from and may face away from the front surface. The interface surface may be arranged to extend between and interconnect the front surface and the back surface. The interface surface may be formed to include a groove that extends into the wall-masking panel between the front surface and the back surface.

In some embodiments, the modular architectural system may include a monolithic interface strip. The interface strip may be formed to include a tongue, a flange, and a bracket. The tongue may be arranged to extend in to the groove of the wall-masking panel. The flange may be arranged to extend over a portion of the front surface of the masking panel. The bracket may be arranged to extend along the interface surface of the wall-masking panel and to interconnecting the tongue and the flange. It is contemplated that, the bracket may extend along substantially the entire interface surface of the wall-masking panel.

In some embodiments, the monolithic interface strip may include a C-shaped accessory rail. The C-shaped accessory rail may include a rear wall, a top wall extending from the rear wall, and a bottom wall spaced apart from the top wall and extending from the rear wall. The rear wall may be formed to include a hole sized to receive a fastener.

In some embodiments, the flange may extend directly from the C-shaped accessory rail. The tongue may extend directly from the bracket.

In some embodiments, the service unit may include a frame and a L-shaped brace coupled to the frame. The L-shaped brace may be formed to include a hole arranged in line with the hole of the C-shaped accessory rail.

Additional features, which alone or in combination with any other feature(s), including those listed above and those listed in the claims, may comprise patentable subject matter and will become apparent to those skilled in the art upon consideration of the following detailed description of illustrative embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
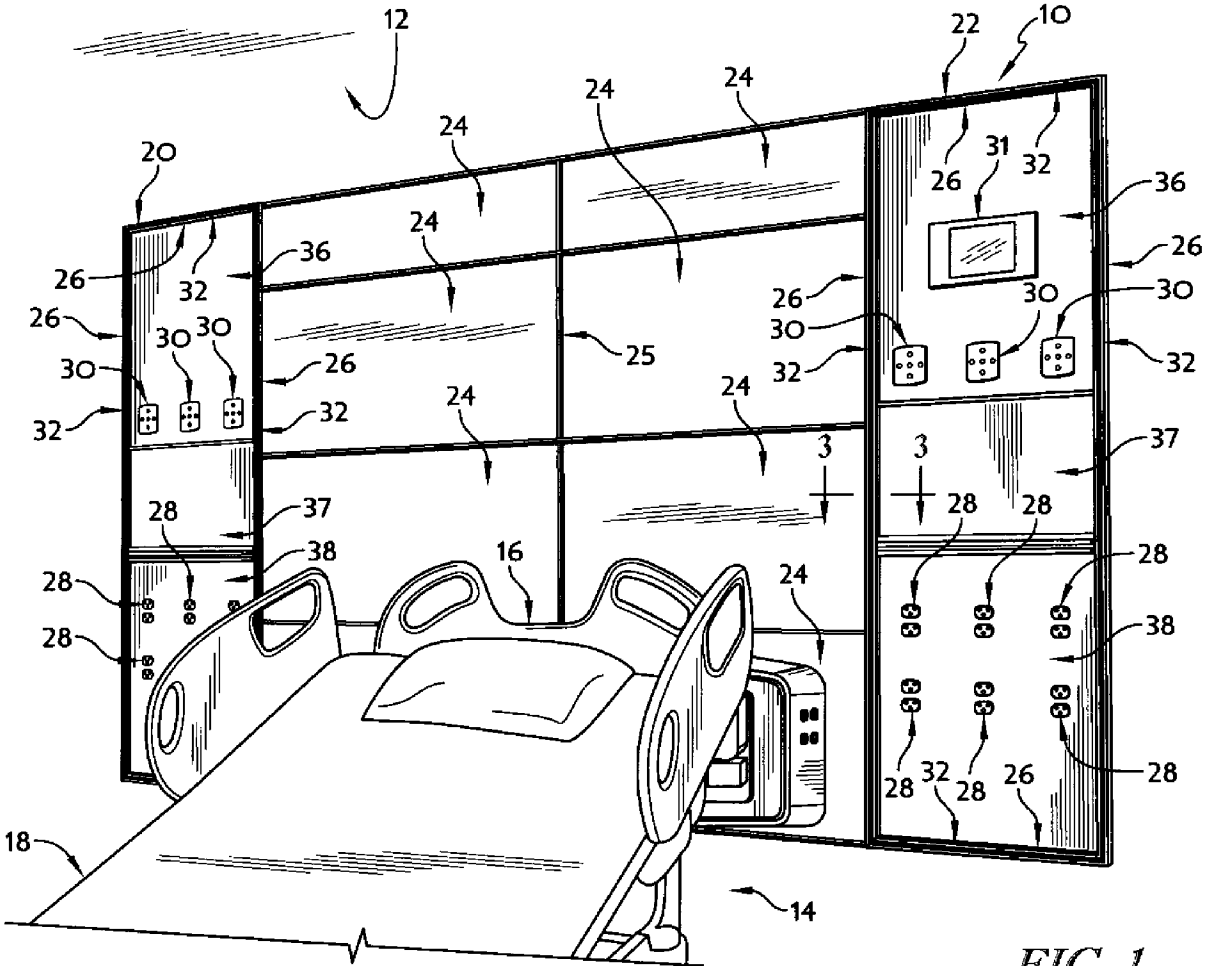
FIG. 1 is a perspective view of a modular architectural room system positioned in a patient room embodied as a multi-unit head wall including two in-wall units with power outlets, service outlets, and an information screen.

Referring to FIG. 1, a modular architectural room system is embodied as an in-wall head wall 10 (sometimes called a console or wall console) installed onto a finished wall 12 of a health facility room 14. The in-wall head wall 10 is positioned in the room 14 at the head end 16 of a hospital bed 18 and provides service outlets 28, for use in the room 14. The in-wall head wall 10 illustratively includes two service units 20, 22 that are constructed so as to extend into the finished wall 12, wall-masking panels 24 that cover portions of the finished wall 12 for aesthetic affect, and interface strips 26 that interconnect the service units 20, 22 and the wall-masking panels 24.

The interface strips 26 are located between and are coupled to both the service units 20, 22 and the wall-masking panels 24 as shown in FIG. 1. The interface strips 26 each have a flange 74 that covers any gaps formed between the service units 20, 22 and the wall-masking panels 24 during construction of the in-wall head wall 10 to provide a finished look to the head wall 10. The interface strips 26 also cover any gaps formed between the service units 20, 22 and the finished wall 12 during construction of the head wall 10. In the illustrative embodiment, the interface strips 26 are formed to include accessory tracks 32 for mounting accessories such as shelves, baskets, IV poles and the like to the head wall 10.

The service units 20, 22 are framed by the interface strips 26. Each service unit 20, 22 includes service outlets 28, 30, information screen 31, and modular panels 36, 37, 38 as shown in FIG. 1. The service outlets 28, 30 are illustratively power outlets 28 and medical gas outlets 30 for use in the health facility room 14. Medical gas outlets 30 may be coupled to sources of pressurized oxygen, pressurized air, vacuum air, and the like located outside of the room 14. The information screen 31 is illustratively configured to display patient, device, and or health facility information. The modular panels 36, 37, 38 support the service outlets 28, 30 and the information screen 31. Other modular panels (not shown) may be swapped into the service units 20 in place of the modular panels 36, 37, 38 to provide other outlet configurations or different types of service outlets, such as data connection outlets.

The wall-masking panels 24 are coupled to the service units 20, 22 by the interface strips 26 and are coupled to one another by support strips 25 that extend between adjacent wall-masking panels 24 as shown, for example, in FIG. 1. The interface strips 26 engage the wall-masking panels 24 via a tongue-and-groove connection 35 (shown in FIG. 3). The support strips 25 also engage the wall-masking panels 24 via a tongue-and-groove connection (not shown). The wall-masking panels 24 are illustratively rectangular and arranged in spaced apart relation to one another to form a grid pattern.

Figure 2:
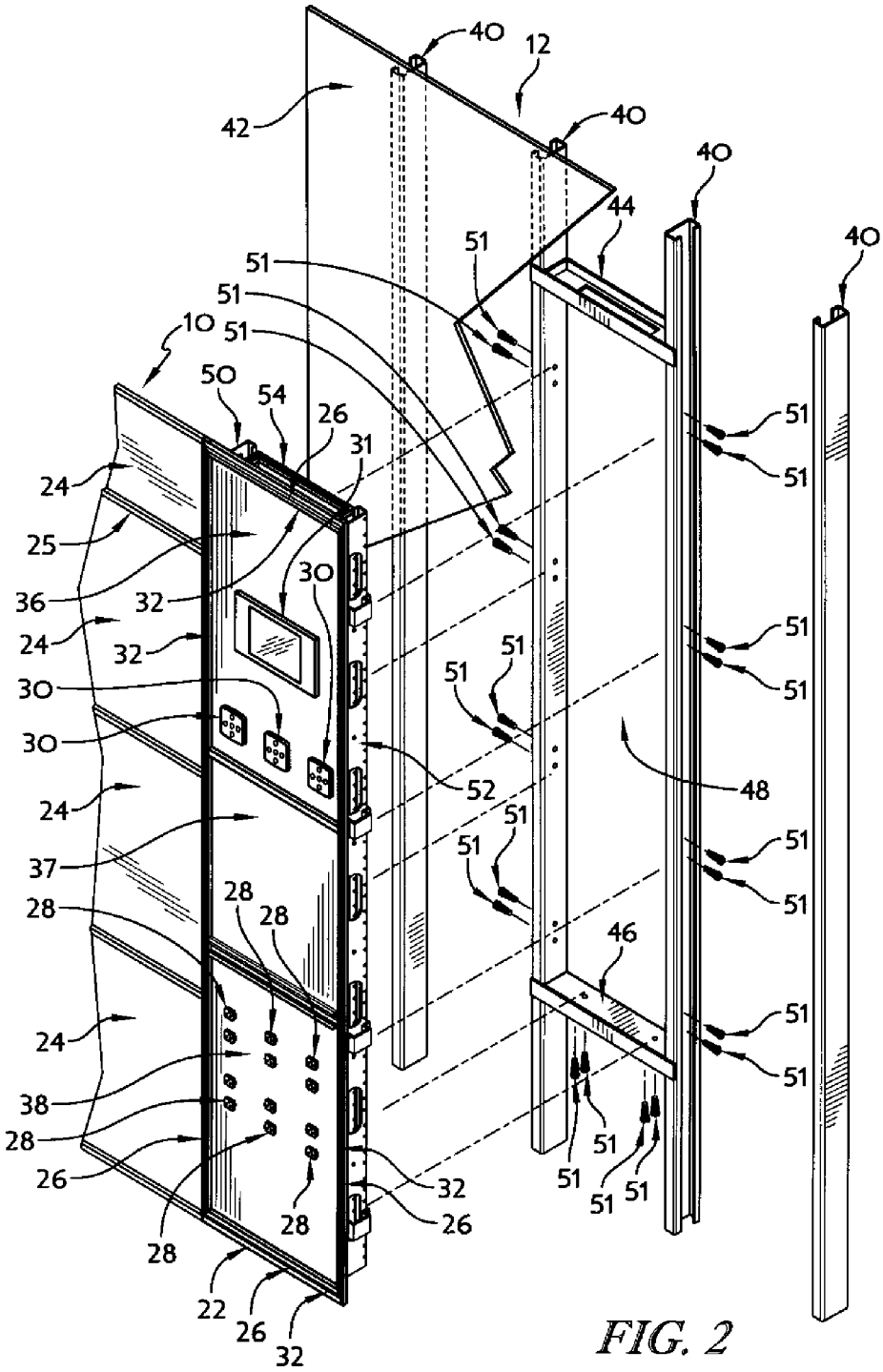
FIG. 2 is a perspective view of one of the in-wall units of FIG. 1 showing the in-wall unit removed from a wall of the patient room, and showing that the in wall unit includes a service unit supporting the outlets and screen, a wall-masking panel adapted to cover the studs of the wall, and a interface strip formed to include an accessory track that extends around the service unit.

Turning now to FIG. 2, a portion of the in-wall head wall 10 is shown removed from the finished wall 12. The finished wall 12 illustratively includes studs 40 and facing sheets 42 (illustratively drywall sheets) coupled to the studs 40. In other embodiments, the finished wall 12 may not include facing sheets 42, in particular in embodiments wherein the in-wall head wall 10 covers an entire side of the room 14. The finished wall 12 also includes a header 44 and a sill 46 extending between two studs 40 to define an opening 48 sized to receive the service unit 22 as shown, for example, in FIG. 2. A portion of the facing sheets 42 corresponding to the opening 48 is removed to allow the service unit 22 to be inserted in to the opening 48 as suggested in FIG. 2.

As suggested in FIG. 2, the service unit 22 includes a frame 50 with a vertical columns 52 and horizontal columns 54. The frame 50 is inserted into the opening 48 formed in the finished wall 12 and is secured to the studs 40 and the sill 46 of the finished wall 12 by a plurality of threaded fasteners 51. The frame 50 is coupled to the modular panels 36, 37, 38 and supports the modular panels 36, 37, 38 relative to the finished wall 12.

The wall-masking panels 24 extend over and cover the facing sheets 42 as suggested in FIG. 2. In the illustrative embodiment, the wall-masking panels 24 are supported by the support strips 25 and the interface strips 26 such that the wall-masking panels 24 are not directly coupled to the finished wall 12 as suggested in FIG. 2.

Figure 3:
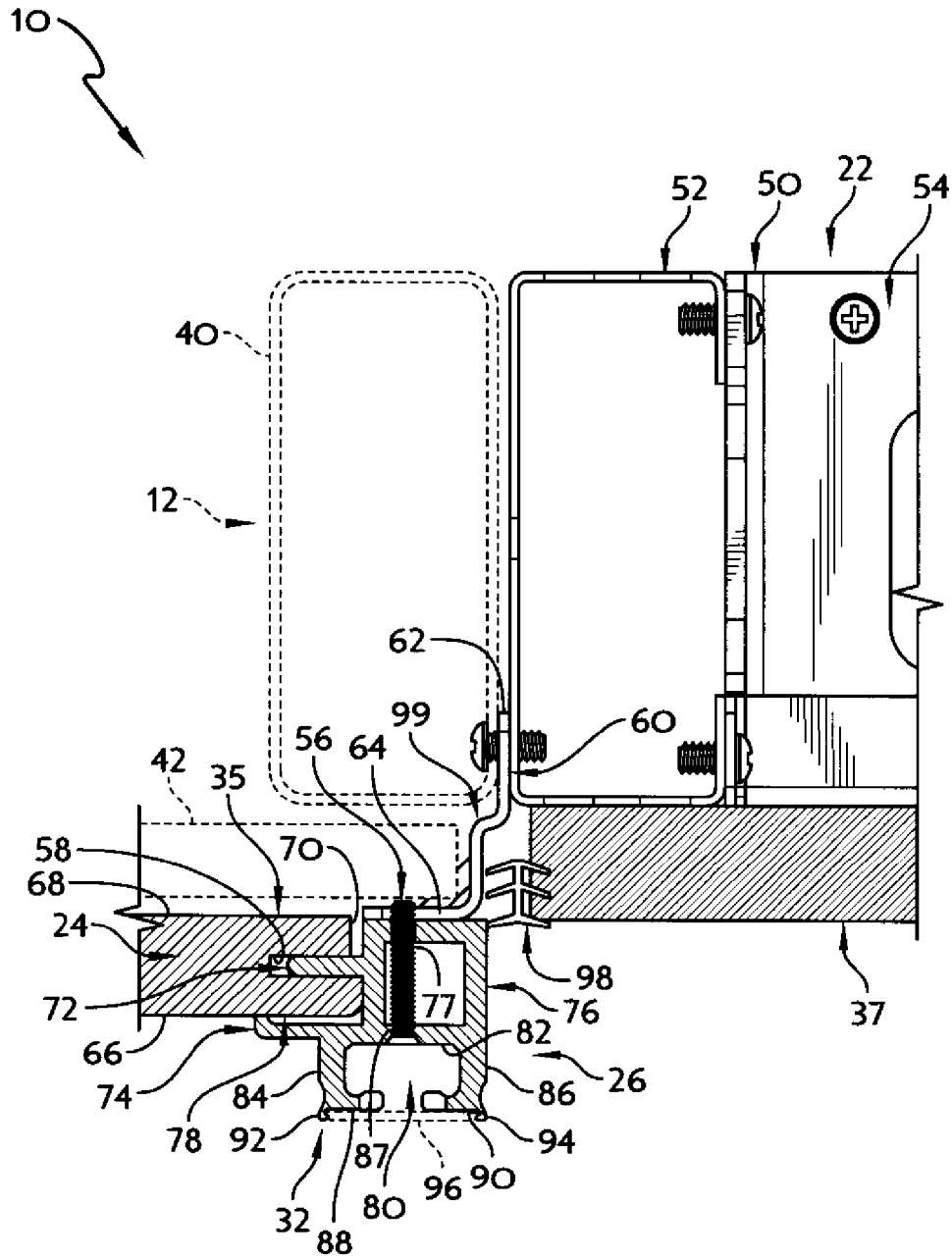
FIG. 3 is a cross-sectional view of a portion of the in-wall unit of FIG. 1 showing that the interface strip is formed to include a flange that extends over a portion of the wall-masking panel to cover any gap between the service unit and the wall-masking panel created during room construction, and showing that the interface strip is formed to include a tongue that extends into a groove formed in the wall-masking panel to couple the interface strip to the wall-masking panel.

Referring now to FIG. 3, a cross-sectional view of a portion of the in-wall head wall 10 and the finished wall 12 shows the connection of the interface strip 26 with the service unit 22 and the wall-masking panel 24. In particular, the interface strip 26 is coupled to the service unit 22 by a threaded fastener 56 and to the wall-masking panel 24 by the tongue-and-groove connection 35.

As shown in FIG. 3, the service unit 22 includes a brace 60 coupled to the interface strip 26 by the fastener 56 and to the frame 50 so that the interface strip 26 is secured to the frame 50. The brace 60 is illustratively L-shaped and includes a first leg 62 coupled to the frame 50 and a second leg 64 coupled to the interface strip 26 by the fastener 56.

The wall-masking panel 24 extends parallel to the facing sheet 42 to cover the facing sheet 42 and is spaced apart from the facing sheet 42 as shown in FIG. 3. The wall-masking panels 24 each include a front surface 66, a back surface 68 facing away from the front surface 66, and an interface surface 70 as shown in FIG. 3. The interface surface 70 is arranged to extend between and interconnect the front surface 66 and the back surface 68. The interface surface 70 is formed to include the groove 58 that extends into the wall-masking panel 24 about mid way between the front surface 66 and the back surface 68. The wall-masking panel 24 is illustratively spaced apart from and arranged along the service unit 22 with the interface surface 70 facing the service unit 22 as shown in FIG. 3.

The interface strip 26 is formed to include a tongue 72, a flange 74, a bracket 76, and the accessory track 32 as shown in FIG. 3. The tongue 72 extends directly from the bracket 76 into the groove 58 formed in the interface surface 70 of the wall-masking panel 24 to form the tongue-and-groove connection 35. The flange 74 is illustratively L-shaped and extends parallel to the front surface 66 of the wall-masking panel 24 to cover a portion 78 of the front surface 66 adjacent to the interface surface 70 of the wall-masking panel 24. The bracket 76 is illustratively C-shaped and extends along substantially the entire interface surface 70 of the wall-masking panel 24. The bracket 76 is also formed to include a hole 77 sized to receive the fastener 56.

The interface strip 26 is illustratively a monolithic extruded aluminum component. In other embodiments, the interface strip 26 may be made from multiple pieces and/or from other materials. In still other embodiments, the interface strip 26, the brace 60, and the corresponding column 52, 54 of the frame 50 may be formed as one monolithic extruded side member (not shown); in such embodiments, the modular panels 36, 37, 38 of the service units 20, 22 may be coupled directly to the monolithic side members.

The accessory track 32 is illustratively C-shaped forming an opening 80 that opens facing away from the back surface 68 of the wall-masking panel 24 as shown in FIG. 3. The accessory track 32 includes a rear wall 82, a top wall 84, and a bottom wall 86. The top wall extends from the rear wall 82 perpendicular to the rear wall 82. The bottom wall 86 is spaced apart from the top wall 84 and extends from the rear wall 82 perpendicular to the rear wall 82. The rear wall 82 is also formed to include a threaded hole 87 sized to receive the fastener 56 and is aligned with the hole 77 formed in the bracket 76.

The accessory track 32 also includes a top strut 88, a bottom strut 90, a top tooth 92, and a bottom tooth 94 as shown in FIG. 3. The top strut 88 extends from the top wall 84 toward the bottom wall 86 and is spaced apart from the rear wall 82. The bottom strut 90 extends from the bottom wall 86 toward the top wall 84 and is also spaced apart from the rear wall 82. The top tooth 92 extends from the top wall 84 away from the rear wall 82 and away from the bottom wall 86. The bottom tooth 94 extends from the bottom wall 86 away from the rear wall 82 and away from the top wall 84.

In some embodiments, a cover strip 96 may be coupled to the accessory track 32 to cover the accessory track 32 when not in use as shown in FIG. 3. In the illustrative embodiment, the cover strip 96 is located between the top tooth 92 and the bottom tooth 94 of the accessory track 32 and covers the opening 80 of the accessory track 32. The cover strip 96 is illustratively made from high pressure laminate (HPL) material but in other embodiments may be made from any other suitable material.

Figure 3A:
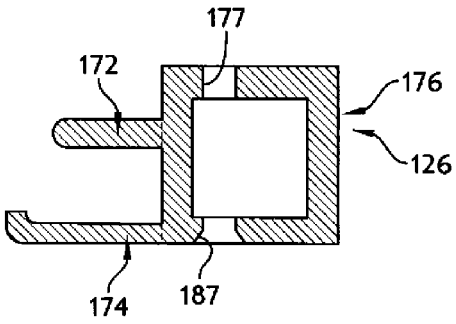
FIG. 3A is a cross-sectional view of a first alternative interface strip without an accessory track.

In an alternative embodiment, an interface strip 126 without an accessory track (as shown in FIG. 3A) may be used in place of the interface strip 26. The alternative interface strip 126 is similar to the interface strip 26 and similar reference numbers in the 100 series indicate similar features described above, the description of which is incorporated by reference. However, unlike the interface strip 26, the flange 174 of the alternative interface strip 126 extends directly from the bracket 176 which is rectangular in shape. Also, the threaded hole 187 is formed through the bracket 176 as shown in FIG. 3A.

Figure 3B:
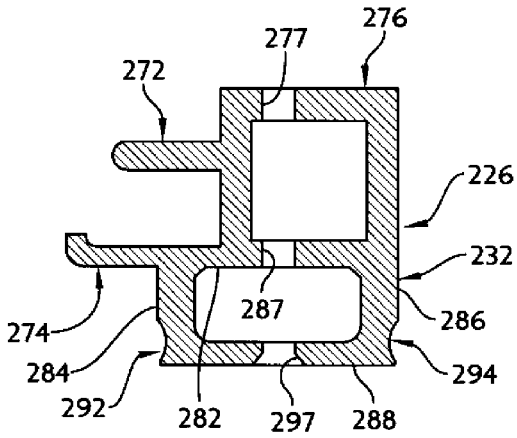
FIG. 3B is a cross-sectional view of another alternative interface strip with a D-shaped accessory track formed to include channels.

In another alternative embodiment, an interface strip 226 with a D-shaped accessory track 232 and no teeth (as shown in FIG. 3B) may be used in place of the interface strip 26. The alternative interface strip 226 is similar to the interface strip 26 and similar reference numbers in the 200 series indicate similar features described above, the description of which is incorporated by reference. However, unlike the interface strip 26, the flange accessory track 232 is D-shaped and includes a rear wall 282, a top wall 284, a bottom wall 286, and a front wall 288. The rear wall 282 is formed to include a hole 287 sized to receive the fastener 56 and the front wall 288 is formed to include a hole 297 as shown in FIG. 3B. The holes 287, 297 are aligned with the hole 77 formed in the bracket 76. The alternative interface strip 226 also includes channels 292 and 294 that extend inwardly toward one another from the top wall 284 and the bottom wall 286 as shown in FIG. 3B.

Figure 3C:
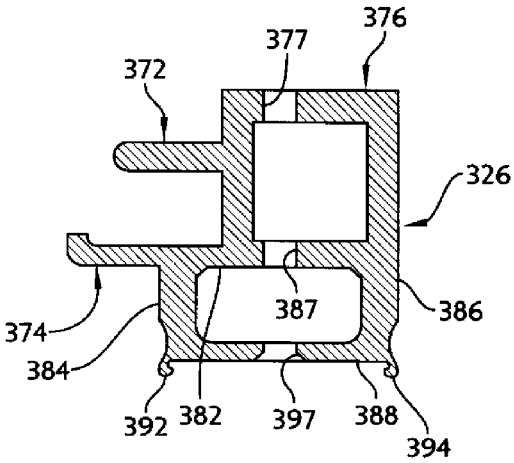
FIG. 3C is a cross-sectional view of yet another alternative interface strip with a D-shaped accessory track with teeth.

In still another alternative embodiment, an interface strip 326 with a D-shaped accessory track 332 and teeth 392, 394 (as shown in FIG. 3C) may be used in place of the interface strip 26. The alternative interface strip 326 is similar to the interface strip 26 and similar reference numbers in the 300 series indicate similar features described above, the description of which is incorporated by reference. However, unlike the interface strip 26, the flange accessory track 332 is D-shaped and includes a rear wall 382, a top wall 384, a bottom wall 386, and a front wall 388. The rear wall 382 is formed to include a hole 387 sized to receive the fastener 56 and the front wall 388 is formed to include a hole 397 as shown in FIG. 3C. The holes 387, 397 are aligned with the hole 77 formed in the bracket 76.

Figure 3D:
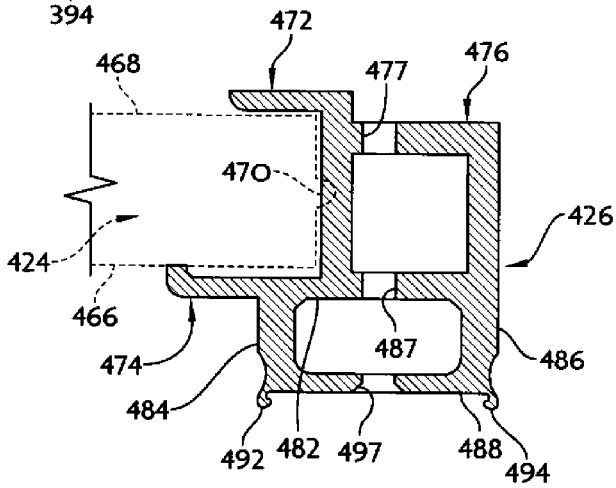
FIG. 3D is a cross-sectional view of still another alternative interface strip with a D-shaped accessory track and configured to receive the wall-masking panel in a U-shaped opening.

In yet alternative embodiment, an interface strip 426 for use with a wall-masking panel 424 without a groove (as shown in FIG. 3A) may be used in place of the interface strip 26. The alternative interface strip 426 is similar to the interface strip 26 and similar reference numbers in the 400 series indicate similar features described above, the description of which is incorporated by reference. However, unlike the interface strip 26, the tongue 472 of the alternative interface strip 426 is arranged to extend along a portion of the back surface 468 of the wall-masking panel 424 so that the wall-masking panel 424 is received in a U-shaped opening formed by the tongue 472, the flange 474, and the bracket 476 as shown in FIG. 3D.

Also, the illustrative head wall 10 includes a gap filler 98 coupled to the service unit 22 as shown in FIG. 3. The gap filler 98 is flexible and may be located between the modular panels 36, 37, 38 and the interface strip 26 to cover any gap between the modular panels 36, 37, 38 and the interface strip 26. In the illustrative embodiment, the first leg 62 of the brace 60 has a jog 99 that provides room for the gap filler 98 to be coupled to the service unit 22 between the first leg 62 and the modular panels 36, 37, 38 as shown in FIG. 3.

Figure 4:
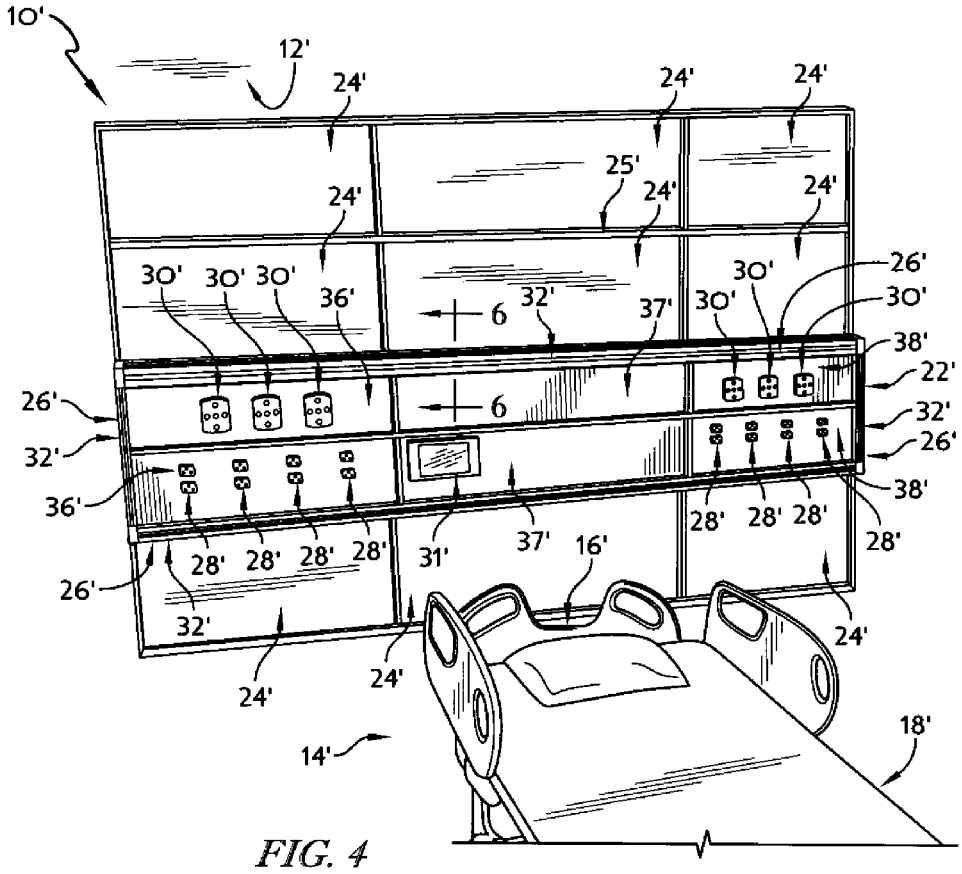
FIG. 4 is a perspective view of another modular architectural room system positioned in a patient room embodied as head wall including an on-wall unit with power outlets, service outlets, and an information screen.
Figure 4A:
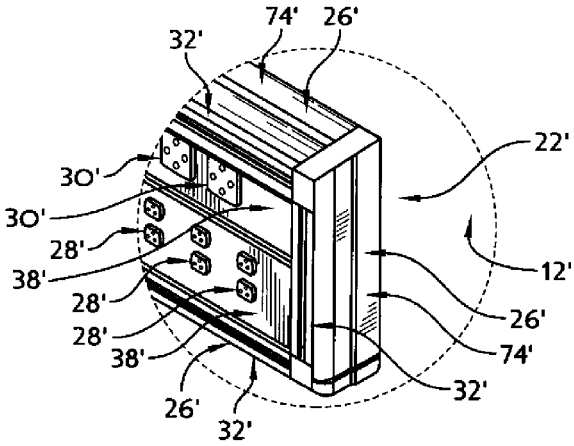
FIG. 4A is a partial perspective view of the on-wall unit of FIG. 4 showing that the on-wall unit extends out from the wall of the patient room.
Figure 5:
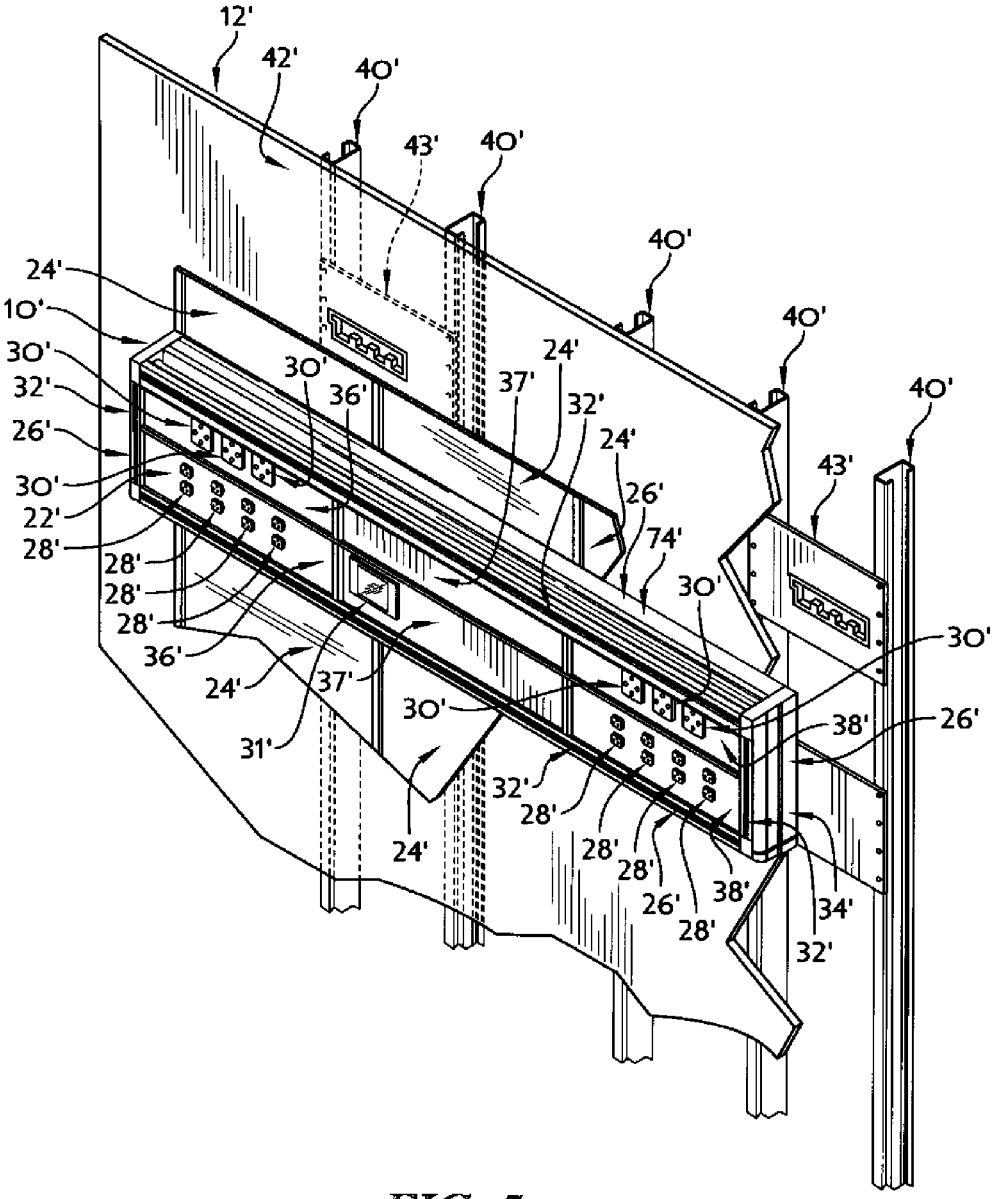
FIG. 5 is a perspective view of one on-wall unit of the modular architectural room system shown in FIG. 4 with the in-wall unit removed from a wall of the patient room showing that, similar to the embodiment of FIGS. 1-3, the on-wall unit includes a service unit, a wall-masking panel adapted to cover the studs of the wall, and a interface strip formed to include an accessory track that extends around the service unit.
Figure 6:
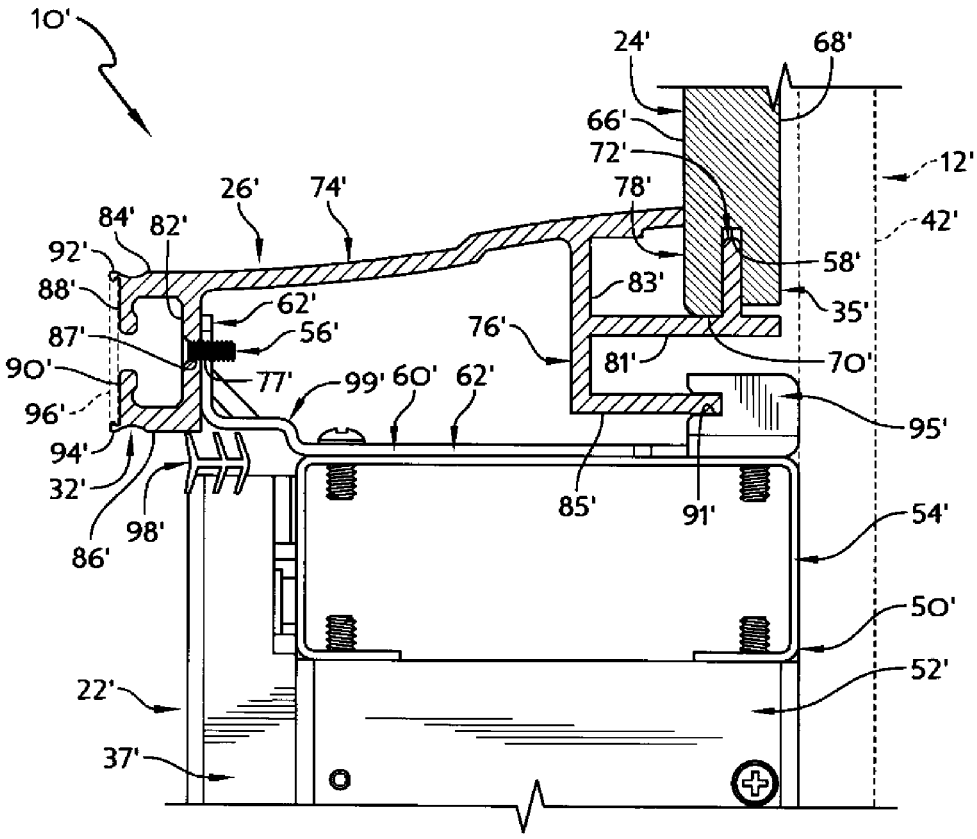
FIG. 6 is a cross-sectional view of a portion of the in-wall unit of FIG. 4 showing that the interface strip is formed to include a flange that extends over a portion of the wall-masking panel to cover any gap between the service unit and the wall-masking panel created during room construction, and showing that the interface strip is formed to include a tongue that extends into a groove formed in the wall-masking panel to couple the interface strip to the wall-masking panel.

Referring now to FIGS. 4-6 a second embodiment of the modular architectural system is shown. Specifically, the second modular architectural system is an on-wall head wall 10' adapted to be mounted on a finished wall 12' in a health facility room 14' as shown in FIG. 4. The on-wall head wall 10' is similar to the in-wall head wall 10 and similar reference numbers in the (') series indicate similar features described above, the description of which is incorporated by reference. However, the on-wall head wall 10' includes a service unit 22' that is mounted on the finished wall 12' and is positioned outside of the finished wall 12' (as suggested in FIG. 4A) rather than extending into the finished wall 12'. The service unit 22' is mounted to the finished wall 12' over the facing sheets 42' via brackets 43' that are secured to the studs 40' as shown in FIG. 5.

To accommodate the service unit 22' extending out of the finished wall 12', the interface strip 26' is modified as shown in FIG. 6. The interface strips 26' function in a manner similar to the interface strips 26 described above.

The interface strip 26' is formed to include a tongue 72', a flange 74', a bracket 76', and an accessory track 32' as shown in FIG. 6. The tongue 72' is similar to the tongue 72 and extends into the groove 58' of the wall-masking panel 24'.

The flange 74' extends from the accessory track 32' toward the front surface 66' of the wall-masking panel 24' at an angle as shown in FIG. 6. The flange 74' covers a portion 78' of the front surface 66' adjacent to the interface surface 70' of the wall-masking panel 24'.

The bracket 76' includes a number of branches 81', 83', 85' as shown in FIG. 6. The first branch 81' extends along substantially the entire interface surface 70' of the wall-masking panel 24'. The second branch 83' extends from and perpendicular to the first branch 81' and supports the flange 74' between the accessory track 32' and the wall-masking panel 24'. The third branch 85' extends from and perpendicular to the second branch 83' and is received in a groove 95' of a stabilizer block 91' included in the service unit 22'. The stabilizer block 91' is coupled to the frame 50' of the service unit 22' as shown in FIG. 6.

The accessory track 32' is illustratively C-shaped forming an opening 80' that opens opposite the back surface 68' of the wall-masking panel 24' as shown in FIG. 6. The accessory track 32' includes a rear wall 82', a top wall 84', and a bottom wall 86'. The rear wall 82' is also formed to include a threaded hole 87' sized to receive the fastener 56' and is aligned with the hole 77' formed in the bracket 76'. The rear wall 82' contacts the bracket 76' when the interface strip 26' is coupled to the service unit 22' by the fastener 56' as shown in FIG. 6.

Figure 7:
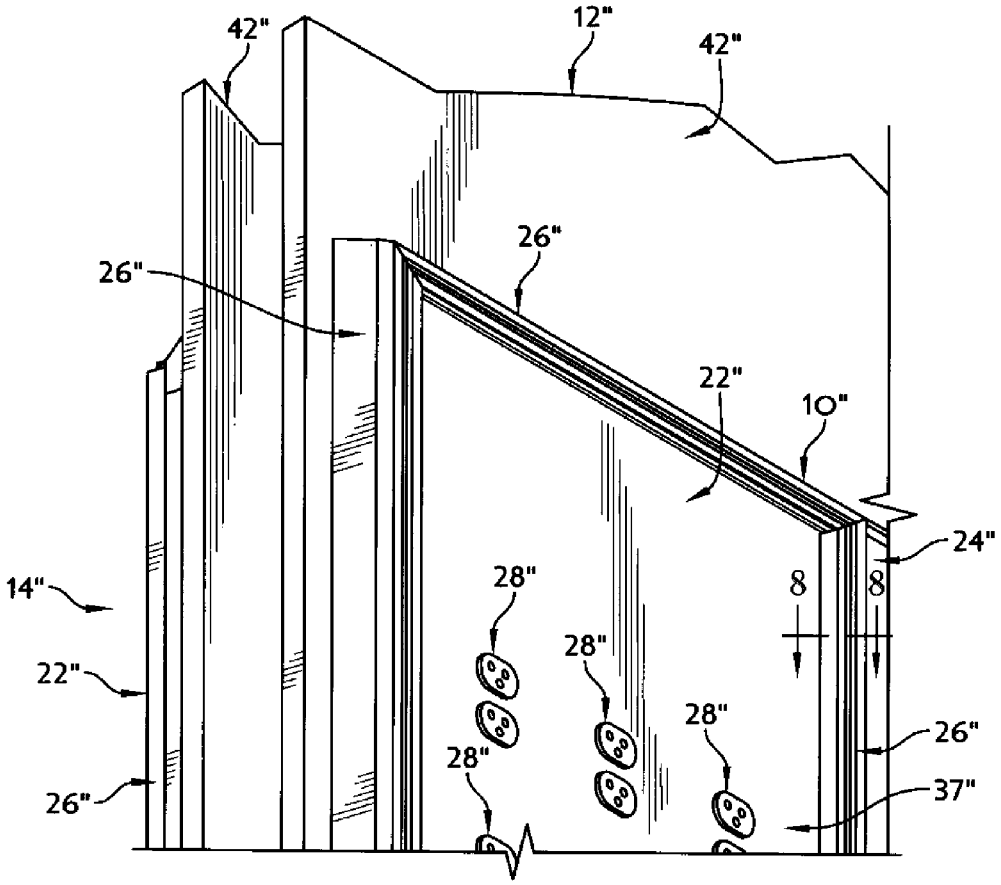
FIG. 7 is a partial perspective view of another modular architectural room system embodied as head wall including a double-sided unit with outlets arranged on opposing sides of a patient room wall.
Figure 8:
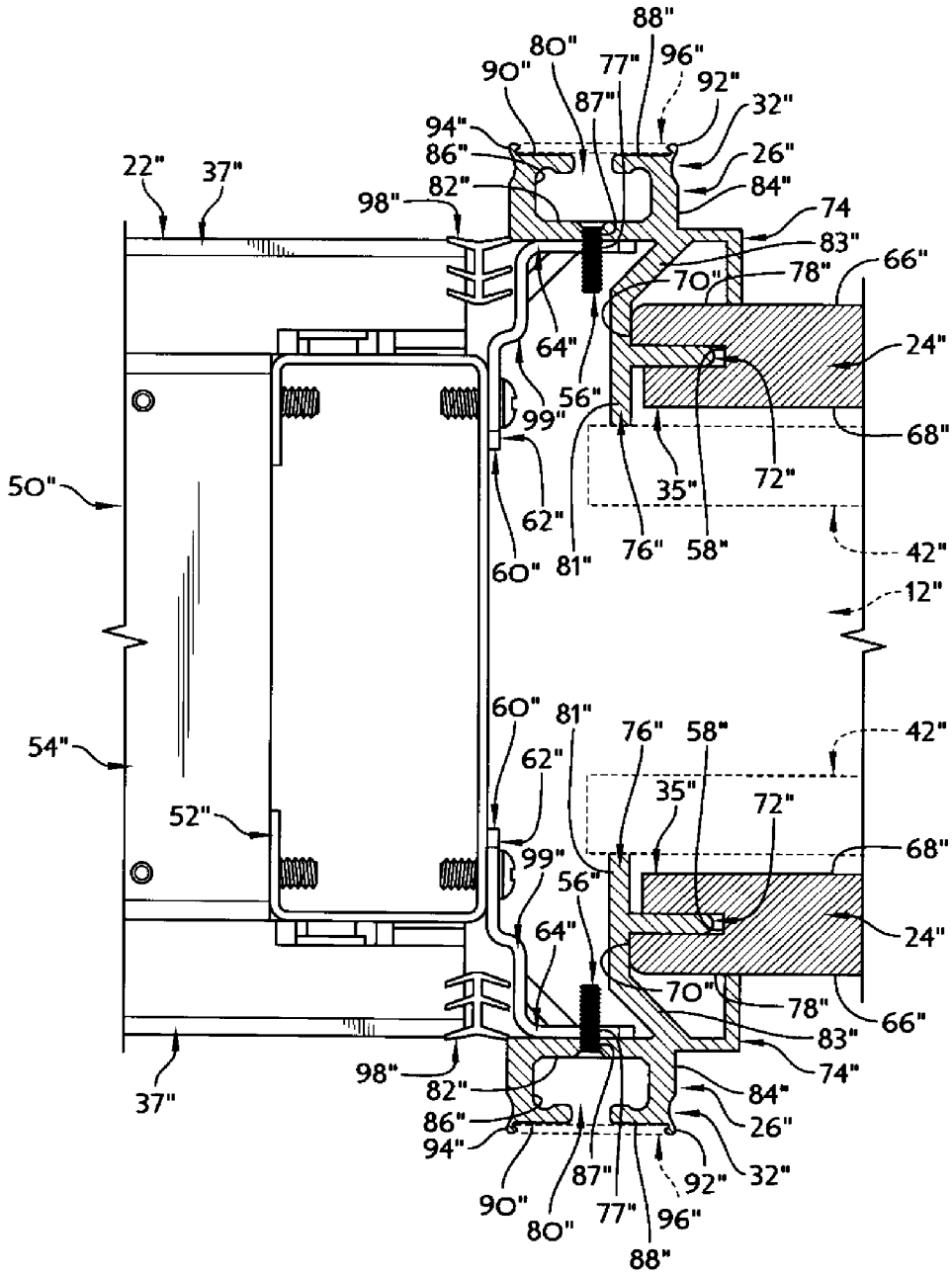
FIG. 8 is a cross-sectional view of a portion of the in-wall unit of FIG. 7 showing that the double sided unit includes a service unit, wall-masking panels adapted to cover the studs of the wall, and interface strips formed to include accessory tracks that extends around the service units, and showing that the interface strips are formed to include flanges that extends over portions of the wall-masking panels to cover any gap between the service unit and the wall-masking panels created during room construction, and showing that the interface strips are formed to include tongues that extends into grooves formed in the wall-masking panels to couple the interface strips to the wall-masking panels.

Referring now to FIGS. 7 and 8 a third embodiment of the modular architectural system is shown. Specifically, the third modular architectural system is a double-sided head wall 10" adapted to be mounted on a finished wall 12" in a health facility room 14" as shown in FIG. 7. The double-sided head wall 10" is similar to the in-wall head wall 10 and similar reference numbers in the (") series indicate similar features described above, the description of which is incorporated by reference. However, the double-sided head wall 10" includes a service unit 22" that extends through opposite sides of the finished wall 12" and is configured to support service outlets 28", 30" on the opposite sides of the finished wall 12" as suggested in FIG. 7.

To accommodate the service unit 22" extending through (and partially out of) the finished wall 12", the interface strip 26" is modified as shown in FIG. 8. The interface strips 26" function in a manner similar to the interface strips 26 described above.

The interface strip 26" is duplicated on both sides of the finished wall 12" and each interface strip 26" is formed to include a tongue 72', a flange 74', a bracket 76', and an accessory track 32" as shown in FIG. 8. The tongue 72" is similar to the tongue 72 and extends into the groove 58" of the wall-masking panel 24".

The flange 74" is illustratively L-shaped and extends from the accessory track 32" toward the front surface 66" of the wall-masking panel 24" as shown in FIG. 8. The flange 74" covers a portion 78" of the front surface 66" adjacent to the interface surface 70" of the wall-masking panel 24".

The bracket 76" includes branches 81' and 83' as shown in FIG. 8. The first branch 81" extends along substantially the entire interface surface 70" of the wall-masking panel 24". The second branch 83" extends from the first branch 81" at an angle and is directly connected to both the flange 74" and the accessory track 32".

The accessory track 32" is illustratively C-shaped forming an opening 80" that opens opposite the back surface 68" of a corresponding wall-masking panel 24" as shown in FIG. 8. The accessory track 32" includes a rear wall 82", a top wall 84", and a bottom wall 86". The rear wall 82" is formed to include a threaded hole 87" sized to receive the fastener 56" and is aligned with the hole 77" formed in a corresponding bracket 76". The rear wall 82" contacts the corresponding bracket 76" when the interface strip 26" is coupled to the service unit 22" by the fastener 56" as shown in FIG. 8.

Although certain illustrative embodiments have been described in detail above, variations and modifications exist within the scope and spirit of this disclosure as described and as defined in the following claims.

The invention claimed is:

1. A modular architectural system for use in a healthcare facility room with a finished wall including studs and facing sheets covering the studs, the modular architectural system comprising a service unit including a plurality of modular panels and at least one service outlet coupled to at least one of the modular panels, a wall-masking panel adapted to extend over the facing sheets of the finished wall, the wall-masking panel having a front surface, a back surface facing away from the front surface, and an interface surface arranged to extend between and interconnect the front surface and the back surface, the interface surface formed to include a groove that extends into the wall-masking panel between the front surface and the back surface, the wall-masking panel spaced apart from and arranged along an edge of the service unit with the interface surface facing the service unit, and an interface strip coupled to the service unit and arranged along the edge of the service unit between the service unit and the wall-masking panel to interconnect the service unit and the wall-masking panel, the interface strip formed to include a tongue that extends into the groove formed in the interface surface of the wall-masking panel and a flange that extends parallel to the front face of the wall-masking panel to cover a portion of the front face, wherein the interface strip includes an accessory track, and the accessory track has a C-shape arranged to form an opening facing away from the back surface of the wall-masking panel.

2. The modular architectural system of claim 1, wherein the service unit includes a frame and a brace coupled to the frame and coupled to the interface strip.

3. The modular architectural system of claim 2, wherein the brace is L-shaped.

4. The modular architectural system of claim 1, wherein the flange extends directly from the accessory track.

5. The modular architectural system of claim 4, wherein the flange is L-shaped.

6. The modular architectural system of claim 1, wherein the interface strip is formed to include a bracket and the tongue extends directly from the bracket.

7. The modular architectural system of claim 6, wherein the accessory track extends directly from the bracket, and the flange extends directly from the accessory track.

8. The modular architectural system of claim 6, wherein the bracket extends along the entire interface surface of the wall-masking panel.

9. The modular architectural system of claim 1, wherein the service outlet is a medical gas outlet.

10. The modular architectural system of claim 1, wherein the groove formed in the interface surface of the wall masking panel is located about mid-way between the front surface and the back surface of the wall-masking panel.

11. A modular architectural system for use in a healthcare facility room with a finished wall including studs and facing sheets covering the studs, the modular architectural system comprising a service unit including a plurality of modular panels and at least one service outlet coupled to at least one of the modular panels, a wall-masking panel adapted to extend over the facing sheets of the finished wall, the wall-masking panel having a front surface, a back surface facing away from the front surface, and an interface surface arranged to extend between and interconnect the front surface and the back surface, the interface surface formed to include a groove that extends into the wall-masking panel between the front surface and the back surface, the wall-masking panel spaced apart from and arranged along an edge of the service unit with the interface surface facing the service unit, and an interface strip coupled to the service unit and arranged along the edge of the service unit between the service unit and the wall-masking panel to interconnect the service unit and the wall-masking panel, the interface strip formed to include a tongue that extends into the groove formed in the interface surface of the wall-masking panel and a flange that extends parallel to the front face of the wall-masking panel to cover a portion of the front face, wherein the interface strip includes an accessory track, the service unit includes a frame and a brace coupled to the frame and coupled to the interface strip, and the brace is coupled to the interface strip by a fastener extending through the interface strip and the brace.

12. The modular architectural system of claim 11, wherein the accessory track is D-shaped.

13. A modular architectural system for use in a healthcare facility room with a finished wall including studs and facing sheets covering the studs, the modular architectural system comprising service unit including a plurality of modular panels and at least one service outlet coupled to at least one of the modular panels, a wall-masking panel adapted to extend over the facing sheets of the finished wall, the wall-masking panel having a front surface, a back surface facing away from the front surface, and an interface surface arranged to extend between and interconnect the front surface and the back surface, the interface surface formed to include a groove that extends into the wall-masking panel between the front surface and the back surface, the wall-masking panel spaced apart from and arranged along an edge of the service unit with the interface surface facing the service unit, and an interface strip coupled to the service unit and arranged along the edge of the service unit between the service unit and the wall-masking panel to interconnect the service unit and the wall-masking panel, the interface strip formed to include a tongue that extends into the groove formed in the interface surface of the wall-masking panel and a flange that extends parallel to the front face of the wall-masking panel to cover a portion of the front face, wherein the interface strip includes an accessory track, the interface strip is formed to include a bracket and the tongue extends directly from the bracket, and the interface strip is coupled to the service unit by a fastener that extends through the accessory track and the bracket.

14. A modular architectural system for use in a healthcare facility room, the modular architectural system comprising a service unit including a plurality of modular panels coupled to and supported by a frame and at least one service outlet mounted in at least one of the modular panels, a wall-masking panel having a front surface, a back surface spaced apart from and facing away from the front surface, and an interface surface arranged to extend between and interconnect the front surface and the back surface, the interface surface formed to include a groove that extends into the wall-masking panel between the front surface and the back surface, and a monolithic interface strip formed to include a tongue arranged to extend in to the groove of the wall-masking panel, a flange arranged to extend over a portion of the front surface of the masking panel, and a bracket arranged to extend along the interface surface of the wall-masking panel and to interconnecting the tongue and the flange, wherein the monolithic interface strip includes a C-shaped accessory rail with a rear wall, a top wall extending from the rear wall, and a bottom wall spaced apart from the top wall and extending from the rear wall, and the rear wall formed to include a hole sized to receive a fastener.

15. The modular architectural system of claim 14, wherein the flange extends directly from the C-shaped accessory rail and the tongue extends directly from the bracket.

16. The modular architectural system of claim 14, wherein the service unit includes a L-shaped brace coupled to the service unit and formed to include a hole arranged in line with the hole of the C-shaped accessory rail.

17. The modular architectural system of claim 14, wherein the bracket extends along the entire interface surface of the wall-masking panel.

* * * * *